United States Patent [19]

Grudich

[11] 4,441,653

[45] Apr. 10, 1984

[54] BI-METALLIC VANE VENT DAMPER

[75] Inventor: George Grudich, Rochester, Mich.

[73] Assignee: Paragon Resources, Inc., Warren, Mich.

[21] Appl. No.: 272,444

[22] Filed: Jun. 11, 1981

[51] Int. Cl.[3] ..... G05D 23/02

[52] U.S. Cl. ..... 236/93 R; 126/292; 126/285 R

[58] Field of Search ..... 126/285 R, 289, 292, 126/290; 236/1 G, 93 R, 101 E; 137/846, 847

[56] References Cited

U.S. PATENT DOCUMENTS

| | | | |
|---|---|---|---|
| 1,608,205 | 11/1926 | Francke | 236/93 R |
| 2,673,687 | 3/1954 | Alban et al. | 236/93 R |
| 3,366,333 | 1/1968 | Diehl | 236/93 R |
| 4,191,326 | 3/1980 | Diermayer et al. | 236/93 R |
| 4,272,013 | 6/1981 | Diermayer et al. | 236/93 R |
| 4,337,892 | 7/1982 | Diermayer et al. | 126/285 R |

*Primary Examiner*—James C. Yeung

*Attorney, Agent, or Firm*—Krass, Young & Schivley

[57] ABSTRACT

A thermally actuated damper for insertion in the flue pipe of furnaces consists of a cylindrical section of pipe having a diametrically extending bar fixed across its interior. The bar supports a pair of identical, semi-circular vanes formed of a bi-metallic laminate which project in a common direction from the bar. When the furnace is operating the hot flue gases cause the vanes to bend into abutment with one another so that they extend longitudinally along the flue pipe and allow substantially unrestricted flow of vent gases. When the furnace is off the cooling blades bend outwardly, toward the walls of the flue pipe, substantially blocking the flow of gases through the flue so that the warm air from the heated space is not drawn up the flue.

5 Claims, 3 Drawing Figures

BI-METALLIC VANE VENT DAMPER

DESCRIPTION

1. Technical Field

This invention relates to thermally sensitive flue dampers for use with furnaces and the like.

2. Background Art

Recent increases in the cost of fuel have promoted interest in accessories for improving the efficiency of fuel fired furnaces. One such device comprises a vent damper for insertion in the flue of a furnace to close off the flue when the furnace is not operating and thereby prevent the escape of heated air from the conditioned volume through the flue into the atmosphere.

One type of vent damper employs vanes formed of laminates of sheets of two metals having dissimilar coefficients of thermal expansion. The vanes are positioned in the furnace flue with one of their edges fixed and their other edge free to move. When the furnace is operating and the blades are heated by the vent gases, they assume positions with their surfaces lying longitudinal to the axis of the flue pipe allowing substantially unrestricted flow of the flue gases. When the furnace shuts off and the blades cool, their differential contraction bends them into a position in which they substantially block the passage of gases through the flue and thus prevent the heated gases from the interior of the conditioned building from being drawn out through the flue. U.S. Pat. Nos. 3,228,605; 3,510,059; 4,141,495 and 4,159,078 exemplify this form of bi-metallic vane flue damper.

Previous bi-metallic vane flue dampers have required stops which limit the motion of the blades in both the open and closed positions. These stops insure the proper positioning of the blades at the limits of their motion and prevent over-bending which might result in improper operation of the damper, noisy "oil-canning" of the vanes, or permanent distortion of the blades.

One design, produced by Gas Master Products, Inc. of Indianapolis, Indiana, employs a pair of semicircular laminated vanes having their truncated ends secured to a diametrically extending fixed bar within the vent housing so that the vanes extend from the bar in opposed directions. When the furnace is operating the heated vent gases cause the vanes to flatten so that they project in a plane longitudinal to the axis of the vent pipe, in opposed directions, and abut longitudinally projecting stops which extend in opposite directions from the support bar. When the furnace turns off and the vanes cool their differential contraction causes them to curve outwardly in opposed directions, so that the cross sections of the two blades form an "S" shape and block the flow of gases through the flue.

SUMMARY OF THE INVENTION

The present invention is directed toward a form of bi-metal vane vent damper which is extremely simple in construction, so as to be low in cost and reliable in operation, as well as compact and simple to install.

The invention employs a pair of semi-circular bi-metallic laminated vanes having their flat or truncated edges secured to a bar extending diametrically across a section of vent pipe, so that the vanes, when heated by the furnace vent gases, extend longitudinally along the pipe in the same direction, with their sides in abutment with one another. In this manner the motion of each blade upon heating is limited by the opposite blade, eliminating the need for a stop and eliminating the possibility of overtravel. The vanes are secured to the bar so that the bi-metal surfaces having the lower coefficient of thermal expansion oppose one another. When the vanes cool after the furnace is de-energized, the resulting contraction of the two metals causes the free ends of the vanes to bend outwardly in opposed directions, to bring them into proximity with the housing walls substantially blocking flow through the vent. The vanes are shaped and sized so they do not make intimate contact with the housing walls when in an open position but rather provide a slight clearance so that uncombusted gases from the furnace due to a faulty fuel valve or the like can escape.

The damper is preferably mounted in the flue so that the blades project downwardly, eliminating the possibility of debris falling through the flue, being caught and retained between the blades when they are in a flue closing position and thereby preventing the blades from opening properly.

Other objectives, advantages and applications of the present invention will be made apparent by the following detailed description of a preferred embodiment of the invention.

BRIEF DESCRIPTION OF THE DRAWINGS

The description makes reference to the accompanying drawings in which.

DETAILED DESCRIPTION

Figure 1:
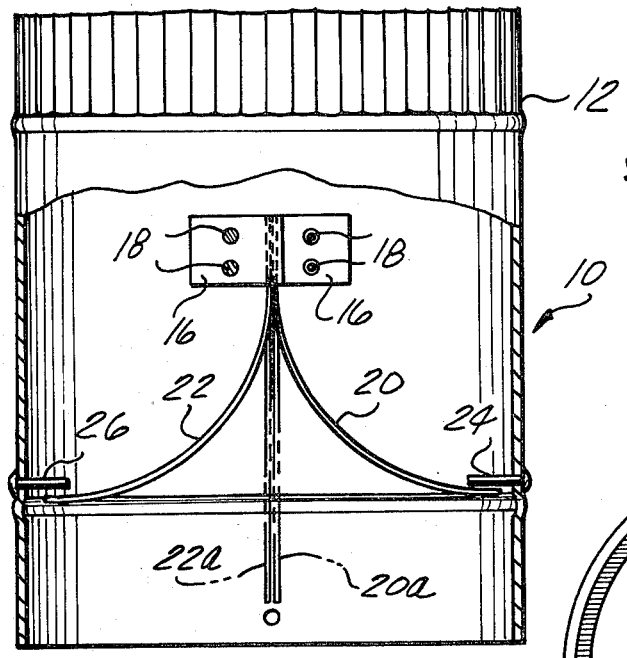
FIG. 1 is an elevation view of a damper formed in accordance with the present invention, partially broken away for purposes of illustration.
Figure 3:
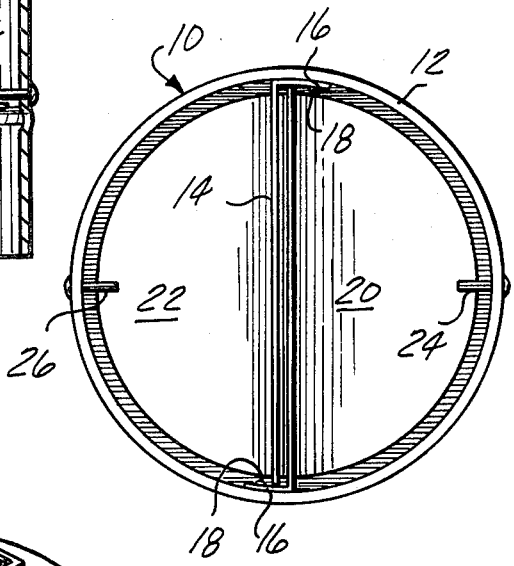
FIG. 3 is a top view of the damper with the blades in the extended, flow blocking position.
Figure 2:
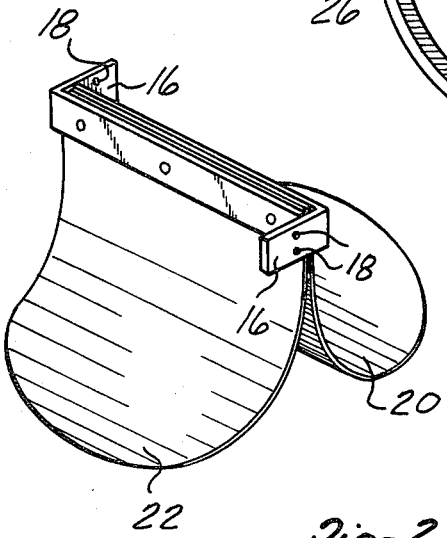
FIG. 2 is a perspective view of the damper blade mechanism, removed from the supporting duct section.

Referring to the drawings, the damper of the present invention is formed within a section of conventional cylindrical, sheet metal exhaust pipe 10 formed with a reduced diameter corrugated section 12 at one end to form a female joinder to a downstream section of vent duct.

An elongated metal bar 14 has a length substantially equal to the interior diameter of the vent duct section 10 and has a pair of normally extending ears 16 projecting in opposite directions from its opposed ends. The ears 16 are joined to diametrically opposed points on the interior sidewalls of the section 10, as by rivets 18, so that the bar 14 projects diametrically across the pipe with its flat surface parallel to the longitudinal axis of the duct.

A pair of identical damper blades 20 and 22 are each formed of a bi-metal laminate of two alloys having slightly different coefficients of thermal expansion. Such materials are commercially available. The blades are each substantially semi-circular in shape and each has its flat edge secured to one of the sides of the bar 14, as by spot welding. The sheets are secured to the bar with their surfaces having the lower coefficient of expansion of the bi-metal secured in opposition to one another. The bars are formed so that at room temperature they are bowed and when they experience a higher temperature, such as that associated with the passage of the flue gases through the damper, they straighten out until they abut one another in the phantom position indicated by the lines 20*a* and 22*a* of FIG. 1. In this position, their opposed surfaces contact one another and act as mutual stops. In this position the flue is substantially unrestricted and flue gases may readily flow.

In the absence of furnace operation the blades bow outwardly as they cool, in opposed directions, until the centers of their arcuate sections contact a pair of stops 24 and 26, which project inwardly from diametrically opposed points on the interior diameter of the vent pipe section 10. In this position the blades 20 and 22 block most of the cross section of the tube, and prevent the free flow of gases, or heated air, through the flue to the exterior. The blades 20 and 22 are shaped so that they do not contact the interior diameter of the damper section when they are in their open position so a slight clearance is provided through which noxious gases may pass.

In a preferred embodiment of the invention the damper section 10 is mounted within the flue pipe so that the blades 20 and 22 project downwardly. Therefore, any debris or other objects falling through the chimney will not be captured between the blades. In alternative embodiments, the blades could project upwardly, allowing for use of a shorter pipe section 10 since the blades would fit within the female end of the pipe without any chance of obstruction from an adjoining male section.

I claim:

1. A damper for a furnace exhaust gas flue, comprising:

a cylindrical sheet metal housing section adapted to be disposed within the flue so that vented combustion gases from the furnace pass through the housing;

a pair of flat members each having an elongated portion and an ear portion disposed within the housing with the ear portions secured to diametrically opposed points on the interior of the housing so that the longitudinal axis of the flat members extend at right angles to the longitudinal axis of the housing, with the sides of the flat members being parallel to the longitudinal axis of the housing; and a pair of semi-circular vanes formed of two separate sheets each consisting of two laminated metal layers, one layer having a relatively high coefficient of thermal expansion and the other having a relatively low coefficient of thermal expansion, each vane having a generally flat upper end with flat opposing sides and curved lower edges, means to secure the upper ends of the two vanes to the elongated portion of the flat members, the elongated portions of the two members serving to sandwich the upper ends of the two vanes together in directly abutting relationship, so that the flat side edges of the vanes extend normally to the longitudinal axis of the housing, the two vanes projecting from the flat members in the direction of the furnace free from any structure between the vanes, and being designed so that they curved outwardly, in opposed directions, when disposed at a temperature below the temperature they experience when the furnace is operating to block a major portion of the cross-sectional area of the flue, and bend under the force of their differential expansion when the furnace is operating so that their planes lie substantially parallel to the longitudinal axis of the flue, with the vanes abutting each other substantially throughout their entire lengths thereby allowing substantially unrestricted gas flow through the flue.

2. The damper of claim 1 including a pair of stops secured to diametrically opposed points on the interior of the housing, each displaced at 90° from points of attachment of said bar to the housing, the stops projecting radially inwardly and being adapted to contact the unsecured edges of the vanes when the vanes move to a closed position to prevent extension of the vanes beyond the plane of the stops.

3. The vent damper of claim 1 wherein the housing is adapted to be inserted into an existing section of cylindrical flue pipe and the housing section in the direction of the extension of the unsecured ends of the vanes when the vanes are in an open position constitutes a female section of enlarged diameter relative to the main diameter of the housing and the opposed end of the housing is of a male, reduced diameter relative to the central diameter of the housing.

4. The vent damper of claim 1 wherein the vane configuration is such that the curved edges of the vanes are spaced from the adjacent interior walls of the housing when the vanes are in a closed position, allowing restricted passage of vent gases through the housing.

5. A damper for a furnace exhaust gas flue, said damper comprising:

a sheet metal tube section having an upper male portion of reduced diameter relative to the central diameter of the tube and a lower female section of enlarged diameter, said tube being adapted to be inserted into an existing section of a cylindrical flue pipe such that the lower female section is attached to the flue pipe in the direction of the furnace;

a pair of semi-circular vanes formed of two separate sheets each consisting of two laminated metal layers, one layer having a relatively high coefficient of thermal expansion and the other having a relatively low coefficient of thermal expansion, each vane having a generally flat upper end with flat opposing sides and curved lower edges;

means disposed within the housing for securing the upper ends of the two vanes together in directly abutting relationship, with the lower edges of the vanes projecting in the direction of the furnace toward said female section, said means including a pair of L-shaped flat members each having an elongated portion and an ear portion, the elongated portions of the two members serving to sandwich the upper ends of the two vanes together and the ear portions of the two members being secured to diametrically opposed points on the interior of the tube; and at least a pair of stops secured to diametrically opposed points on the interior of the tube and spaced longitudinally from the vane securing means so as to contact the curved lower edges of the vanes when in a closed position to prevent the vanes from completely contacting interior surfaces of the tube thereby allowing restricted passage of vent gases through the tube and wherein the vanes may abut each other substantially throughout their longitudinal lengths when in an open position to thereby allow substantially unrestricted gas flow through the tube.

* * * * *